US006470716B1

(12) United States Patent
Öztürk

(10) Patent No.: US 6,470,716 B1
(45) Date of Patent: Oct. 29, 2002

(54) WASHING MACHINE WITH A SUPPRESSED DISCHARGE-PUMP NOISE

(75) Inventor: Emre Öztürk, Istanbul (TR)

(73) Assignee: Arcelik A.S., Istanbul (TR)

( * ) Notice: Subject to any disclaimer, the term of this patent is extended or adjusted under 35 U.S.C. 154(b) by 0 days.

(21) Appl. No.: 09/673,107

(22) PCT Filed: Feb. 8, 1999

(86) PCT No.: PCT/TR99/00006

§ 371 (c)(1),
(2), (4) Date: Dec. 11, 2000

(87) PCT Pub. No.: WO00/46440

PCT Pub. Date: Aug. 10, 2000

(51) Int. Cl.[7] ..... D06F 39/08
(52) U.S. Cl. ..... 68/208; 68/18 F
(58) Field of Search ..... 68/208, 18 F, 184; 134/186, 56 D, 57 D, 58 D, 111

(56) References Cited

U.S. PATENT DOCUMENTS 3,867,821 A * 2/1975 Hurwitz ..... 68/184
5,868,011 A * 2/1999 Hawkins et al. ..... 68/208
5,975,846 A 11/1999 Wistinghausen

FOREIGN PATENT DOCUMENTS

| | | |
|---|---|---|
| DE | 29702253 U1 | 5/1997 |
| DE | 197 38 449 A1 | 3/1998 |
| DE | 19738449 A1 | 3/1998 |

* cited by examiner

*Primary Examiner*—Philip Coe
(74) *Attorney, Agent, or Firm*—Nixon & Vanderhye

(57) ABSTRACT

In the present invention, the disturbing noise of the operating pump created due to the periodic unstable rhythm of the discharge pump when the water level in the tub decreases during the evacuation of the washing machines, is eliminated by providing the cycling of the remaining small amount of water in the machine by means of a by-pass hose (1) placed between the discharge pump and the discharge hose (6).

8 Claims, 3 Drawing Sheets

WASHING MACHINE WITH A SUPPRESSED DISCHARGE-PUMP NOISE

The present invention relates to a washing machine comprising a by pass hose placed between the outlet and inlet of the discharge pump provided for cycling the remaining amount of water in the machine in order to eliminate the noise created due to the periodic unstable rhythm of discharge pump when the water level in the tub decreases during the evacuation of the washing machines.

In the conventional washing machines, generally centrifugal pumps with synchronous motor connected to a filter housing are used. These pumps have very low suction capacities. For this reason when the water level inside the tub falls in the washing machines, the pump cannot evacuate the remaining water and a disturbing noise is created during the operation of the pump.

The object of the present invention is to realize a washing machine, the disturbing noise of which has been reduced, by decreasing the amplitude and increasing the frequency of the periodic pressure detonations which cause the noise in the discharge pump after the drop of the water level inside the tub.

The embodiments of the by-pass hose that reduces the noise of the washing machine discharge pump, realized to achieve the above mentioned object of the invention are illustrated in the attached drawings; wherein.

Figure 1:
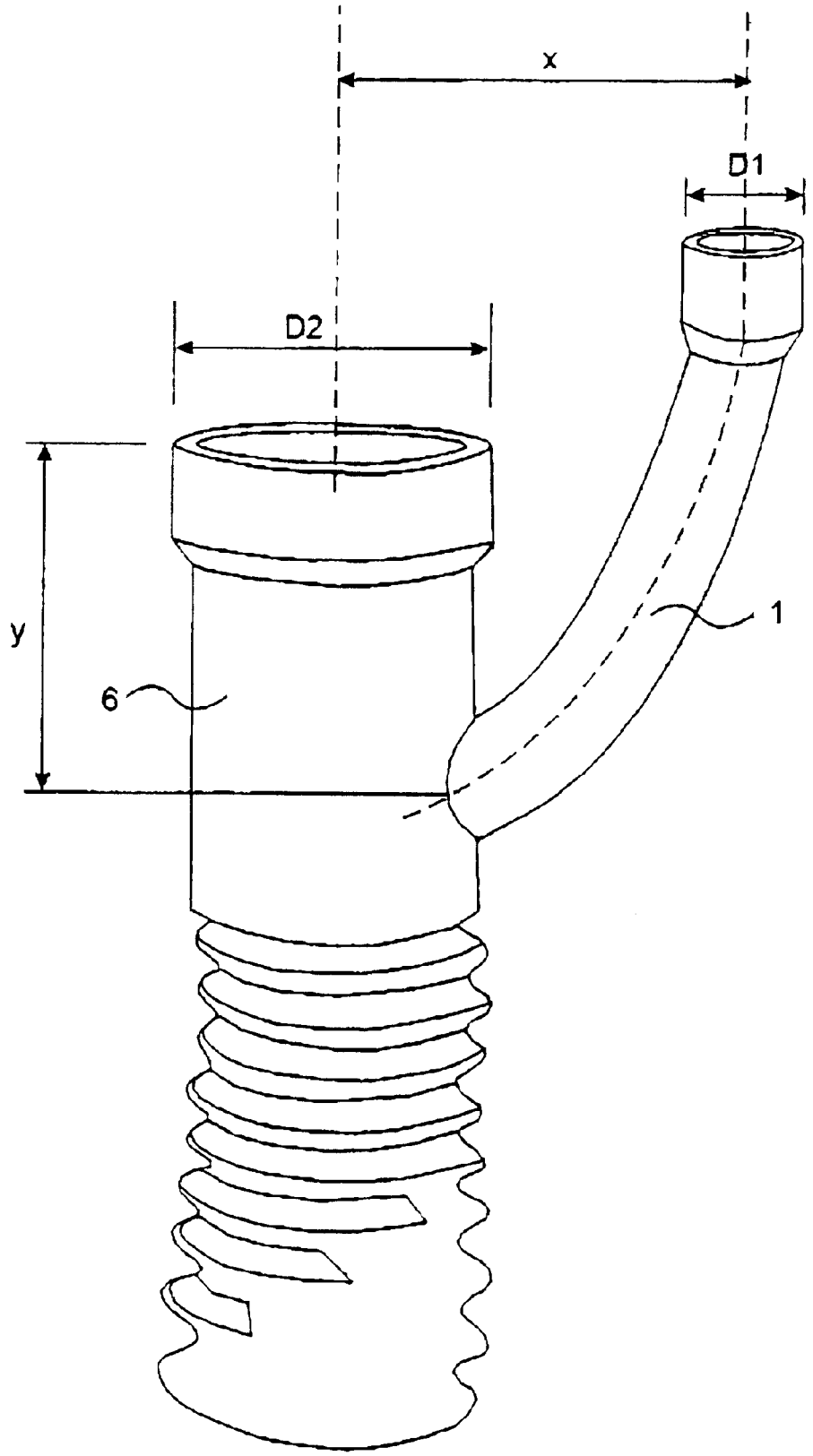
FIG. 1, is a view showing the by-pass and discharge hose.

The parts shown in the drawings are numerated as follows:

1. By pass hose
2. Pump housing
3. Discharge pump
4. Filter housing
5. Impeller (propeller)
6. Discharge hose
7. Connection point of the bypass hose
8. Tub-discharge pump connection hose
9. Tub
10. Inlet for the water from the tub
11. Pump motor
12. Clamp
13. Discharge pump outlet In the washing machines, disturbing noises are created due to the periodic unstable rhythm of the discharge pump (3) because of the low water level (FIG. 3-A) in the discharge pump (3) after most of the water in the tub has been discharged. In order to reduce these noises a by-pass hose (1) with an inner diameter (D1) smaller than the inner diameter (D2) of the discharge pump, i.e. in a certain ratio (25–70%) of the said inner diameter (D2) (FIG. 1) is incorporated between the discharge pump (3) and the discharge hose (6); and the amplitudes of the periodic pressure detonations of the discharge pump (3) are reduced whereas their frequencies are increased.

Figure 2:
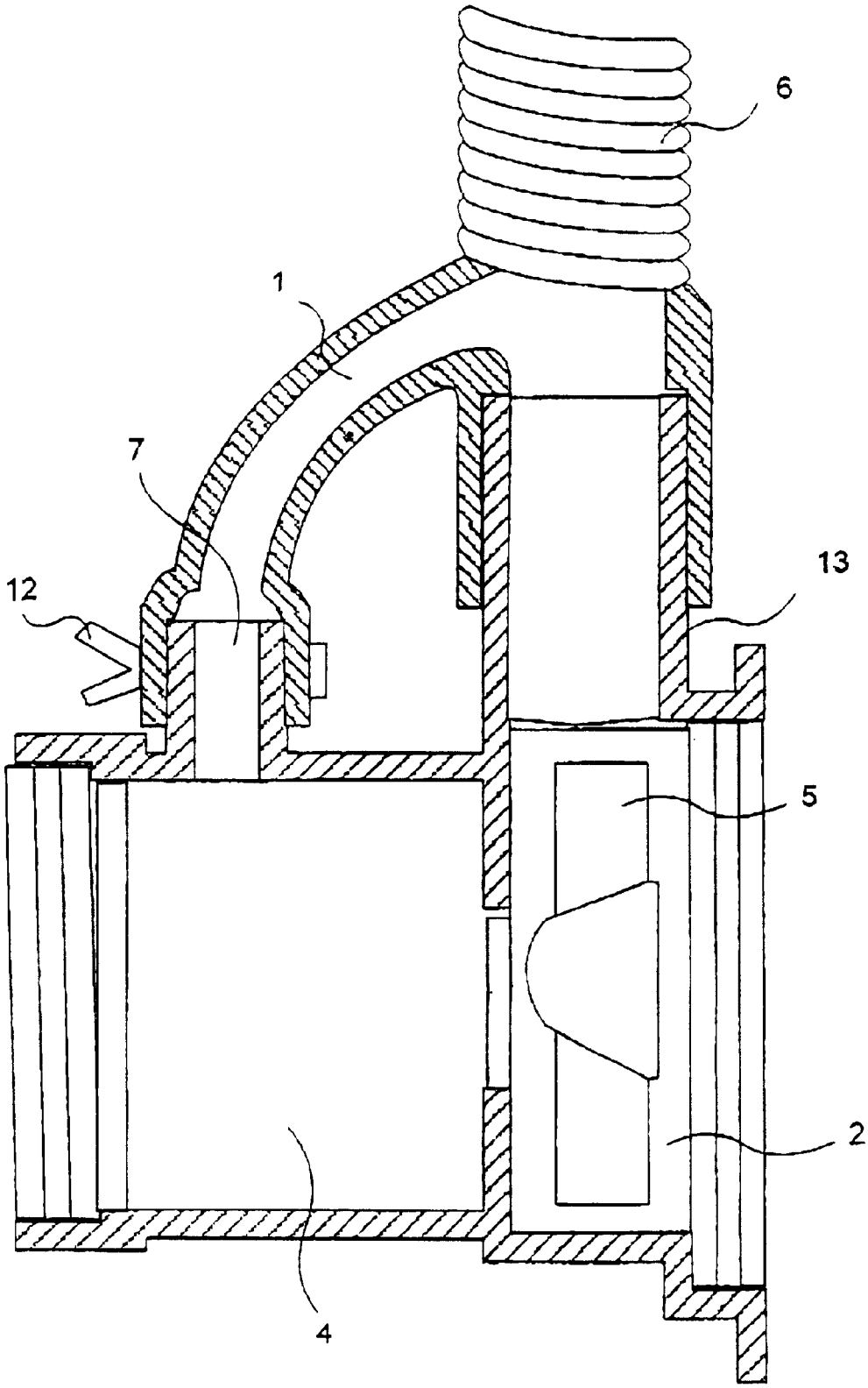
FIG. 2, is a section side view showing the by pass hose with the discharge pump.

Particularly, the bypass hose 1 is connected to the filter housing 4 on the discharge pump 3 as illustrated in FIG. 2. It will be appreciated, however, that the bypass hose 1 may be connected to the pump housing 2 for those pumps which do not have a filter housing 4. Further, the bypass hose 1 may be connected to the tub-discharge connection hose 8, i.e., a water inlet hose from the tub to the pump instead of directly to the pump housing or the filter housing.

Figure 3:
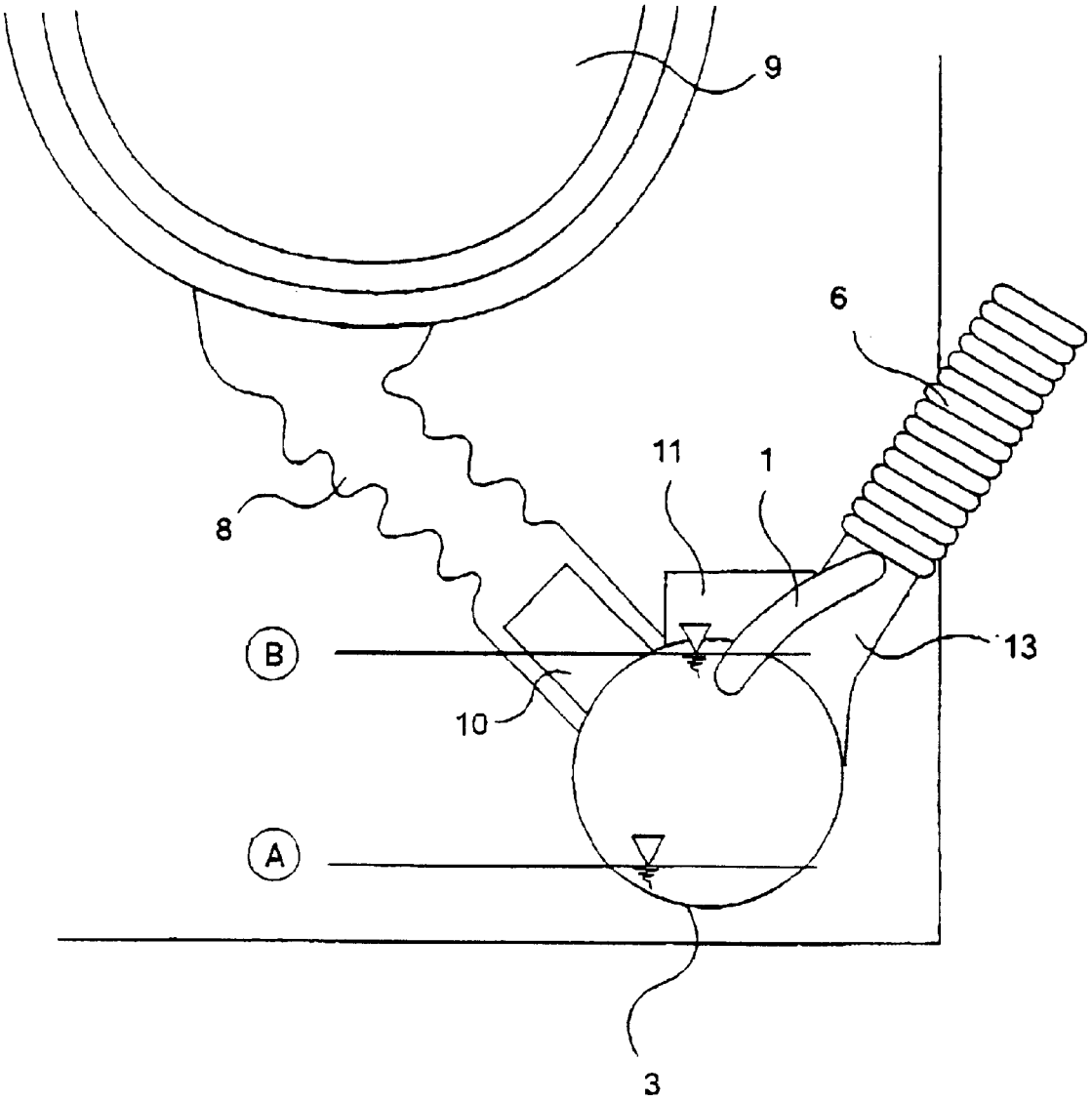
FIG. 3, is the schematic view showing the implementation of the by-pass hose in a washing machine.

The pump motor tries to discharge the water in the pump housing (level A) through the discharge hose. As the amount of the water in the pump housing (2) decreases, water fluctuates through the discharge hose (6). During this fluctuation the impeller (5) contacts with the air-water mixture. The continuous contact of the impeller (5) with water and the suppression of the probable noises have been provided by the recycling of the remaining water in the discharge hose (6) back to the pump housing (2) by means of the by pass hose (1), the outlet of which is connected to the discharge hose (6) (FIG. 3-B).

The inner diameter (D1) of the by pass hose is provided as smaller than the inner diameter (D2) of the discharge hose (6) with a ratio of 25 to 70%, and the by pass hose (1) is placed at a distance (x) of one to three times the inner diameter (D2) of the discharge hose (6), from the axis of the latter. The height (y) of the point where the bypass hose (1) is connected to the discharge hose (6) up to the outlet of the discharge pump (3) is one to three times the inner diameter (D2) of the discharge hose (6).

It is possible to extrude the by pass hose (1) from the same mould as the material of the hose nipple or assemble it later with the discharge hose (6); to connect with the filter housing (4) at an upper point; to place it at the bottom and lateral surfaces of the housing or to connect it to the suction hose instead of the housing. In the discharge pumps with only a pump housing instead of a filtre tank (4), the bypass hose may be placed at any point on the pump housing (2).

The embodiment of the said implementation of the bypass hose (1) for the washing machines is only a example. The referred by pass hose (1) may also be employed in synchronous pumps, dish-washers, machines with dryers as well as in air conditioners.

What is claimed is:

1. A washing machine comprising a tub, a discharge hose having an inner diameter, a discharge pump in communication with the tub and the discharge hose for pumping the water from the tub into the discharge hose, and a bypass hose having an inner diameter, said bypass hose lying in communication with one of the discharge pump and a water inlet hose from the tub connected to the pump and the discharge hose for cycling a small amount of water left inside the tub when the water level in the tub is low to suppress discharge pump noise, the ratio of the inner diameter of the bypass hose to the inner diameter of the discharge hose being greater than 0.25 and less than 0.70.

2. A washing machine according to claim 1 wherein the bypass hose and the discharge hose have respective axes such that the bypass hose axis lies a distance 1–3 times the inner diameter of the discharge hose from the discharge hose axis.

3. A washing machine according to claim 1 wherein the height of the connection between the bypass hose and the discharge hose and an outlet of the discharge pump is 1–3 times the inner diameter of the discharge hose.

4. A washing machine according to claim 1 wherein the bypass hose and the discharge hose are formed of a one piece integral construction.

5. A washing machine according to claim 1, wherein the bypass hose and the discharge hose comprise separate discrete parts.

6. A washing machine according to claim 1, wherein the bypass hose is connected to a filter housing on the discharge pump.

7. A washing machine according to claim 1, wherein the bypass hose is connected to the water inlet hose.

8. A washing machine according to claim 1, wherein the bypass hose and the discharge hose have respective axes such that the bypass hose axis lies a distance 1–3 times the inner diameter of the discharge hose from the discharge hose axis, the height of the connection between the bypass hose and the discharge hose and an outlet of the discharge pump is 1–3 times the inner diameter of the discharge hose.

* * * * *